United States Patent [19]

Saylor

[11] Patent Number: 4,498,379

[45] Date of Patent: Feb. 12, 1985

[54] METHOD FOR FORMING WIRE CONNECTION

[76] Inventor: Millard P. Saylor, 1125 W. Greenbriar, Arlington Heights, Ill.

[21] Appl. No.: 564,842

[22] Filed: Dec. 23, 1983

Related U.S. Application Data

[60] Division of Ser. No. 459,945, Jan. 21, 1983, Pat. No. 4,450,763, which is a continuation-in-part of Ser. No. 273,252, Jun. 12, 1981, abandoned.

[51] Int. Cl.[3] ..... B65B 13/28

[52] U.S. Cl. ..... 100/2; 24/27; 289/1.5; 140/102

[58] Field of Search ..... 100/2, 3, 4, 8, 26, 100/31; 140/101, 93.6, 104, 114, 93 A, 93 R, 118, 149, 102, 102.5; 24/16 R, 27, 28, 29; 289/1.5

[56] References Cited

U.S. PATENT DOCUMENTS

| | | | |
|---|---|---|---|
| 3,086,450 | 4/1963 | Tarbox | 100/31 X |
| 3,099,204 | 7/1963 | Stromberg | 100/31 X |
| 3,179,037 | 4/1965 | Cranston et al. | 100/31 X |
| 3,183,824 | 5/1965 | Cook | 100/31 X |
| 3,213,899 | 10/1965 | Fettkether | 140/118 |
| 3,234,870 | 2/1966 | Missioux | 100/31 X |
| 3,368,590 | 2/1968 | Welden | 140/93 R |
| 3,384,006 | 5/1968 | Helligrath et al. | 100/31 X |
| 3,387,556 | 6/1968 | Cranston et al. | 100/4 |
| 3,557,684 | 1/1971 | Glasson | 100/26 |
| 3,667,377 | 6/1972 | Persson | 100/31 X |
| 3,880,204 | 4/1975 | Sarff et al. | 140/93 A |
| 4,167,902 | 9/1979 | Bister et al. | 100/3 |
| 4,178,845 | 12/1979 | De Gryse | 100/31 X |
| 4,252,157 | 2/1981 | Ohnishi | 140/93 A |

*Primary Examiner*—Billy J. Wilhite

*Attorney, Agent, or Firm*—Edward D. Gilhooly

[57] ABSTRACT

Wire connections as disclosed and the method and apparatus to secure the ends of an elongated member, such as bale wire and the like, employed to secure bales of material for transport and storage. The bale wire connections include a pair of loops forming interconnecting members, which are interlocked by automated techniques to form a strong coupling of the ends of the bale wires used in securing bulk material.

3 Claims, 19 Drawing Figures

12
10
12
20

20
22a
22
24
24a 121
174b
172b
170
172a
174a 10
12
52
52
12a
50
42
48
12b
60
44
50

10
12
46
42
44
12a
60
60

10
22a
22
24
24a

METHOD FOR FORMING WIRE CONNECTION

This application is a divisional application of Ser. No. 459,945, filed Jan. 21, 1983, now U.S. Pat. No. 4,450,763, which is a continuation-in-part application of application Ser. No. 273,252, filed June 12, 1981 and which is now abandoned.

BACKGROUND OF THE INVENTION

This invention relates in general to wire connections, and, in particular, to an improved technique to connect the ends of an elongated wire member.

More specifically, but without restriction to the particular use which is shown and described, this invention relates to wire connections and the method and apparatus to secure the ends of an elongated member, such as bale wire and the like, employed to retain bales of material for transport and storage. The bale wire connection of the invention includes a pair of loops forming interconnecting members, which may be interlocked by automated techniques to form a strong coupling of the ends of the bale wires used in securing bulk material.

It is common practice to retain a large package or bundle of material, generally referred to as a bale, by means of a plurality of elongated straps, metal wires and the like wrapped around the material. Such baling members thus retain the material in its baled form to enable it to satisfactorily be transported and stored during various stages from its raw form to its final utilization by a textile mill and the like. Many types of material generally are shipped and stored in bales, such as waste paper, wool, man-made fiber staple, cotton, fiberglass and the like.

The use of metallic wire is one of the preferred techniques for securing bales of such material for transport. Bale wire is particularly suitable for use in the securement of bales of cotton that are transported from the gin, where the raw cotton is separated, to the warehouse, where the cotton is stored and later sold for use in textile mills and the like. At the cotton gin, the raw fiber cotton is separated from the remaining plant material and is pressed by a press machine into a bale having a selected density and size. In general, seven different sizes of bales for cotton are accepted for shipment in the United States with varying dimensions and density per cubic foot. The density of the cotton bale compressed at the gin mill may range from a low density bale, requiring six bale wires, to a high 28 pound density one, requiring eight wires for adequate securement.

In use of bale wire for securing cotton bales of the type described, it is standard practice in the industry to apply the tie to the bale at the gin, while the bale is still under compression. The wire is wrapped or looped around the bale, and its ends are manually secured together by a square knot joint or crosshead connection, a descriptive term derived from the physical configuration of the wire at the joint. The use of the well-known manual type connections to join the ties applied to the bale presents several deficiencies in use. The strength of the square knot connection, for example, is generally subject to fracture at a load substantially less than the failure strength of the wire itself. Because of its inherent weakness, a square knot connection must be situated in most uses disadvantageously at the top of the bale, where the least tensile load is encountered. Upon release of the compression being applied to the bale by the gin press, the wire tie is subjected to a considerable loading, such that the square knot configuration of the joint is pulled into a smaller compressed form, which cannot later be readily disengaged.

A preferred cotton bale is known as a gin universal density bale. Such a bale is compressed to a density of 28 pounds per cubic feet directly at the gin and can be shipped to the cotton user without intermediate recompression. Ties for a gin universal bale must be no smaller than 9 gauge, and a joint having a breaking strength considerably greater than 90% of the wire strength must be employed, if situated at the side of the bale. A square knot type connector cannot attain such results, since it is only approximately 65% as strong as the wire.

Being a dense bale compressed directly at the gin, it is becoming disadvantageous to secure wire to a gin universal by hand methods. Federal regulations, such as O.S.H.A., and the like have rendered hand tying to be more and more unacceptable. Moreover, conventional hand baling uneconomically requires the use of two or more men to accomplish the task. Because of these reasons, automated techniques for applying wires to secure bales is becoming a necessity in high speed ginning operations. However, prior art connections directly formed on the machines at the bale have not achieved the high strength levels necessary to secure the highly compressed gin universal bales, and other types, in a manner acceptable to meet industry requirements. One common connector, which is stronger than a square knot coupling, is subject to unraveling, while other prior techniques do not demonstrate the strength characteristics needed for joints situated at the side of the bale.

In addition, known designs of apparatus for automating the baling operation are not satisfactory in creating a suitable connection or functioning with the efficiency that is desirable in the field. Past equipment suffers from numerous deficiencies including a lack of operational speed, the employment of overly complex mechanisms, and/or lack of reliability.

SUMMARY OF THE INVENTION

It is, therefore, an object of this invention to provide improved connections for securing the ends of wire and the like.

Another object of this invention is to provide an improved method and apparatus for automatically securing the ends of wire to form a loop around a bale.

A further object of this invention is to improve the strength efficiency of a bale wire connection.

A still further object of this invention is to provide an improved wire connection and method and apparatus for the forming of the connection for baling bundles which meets or exceeds all applicable government regulations.

These and other objects are attained in accordance with the present invention wherein there is provided wire connections for use as a connecting means for elongated bale wires employed to secure bales of material, such as cotton, waste paper, wool, man-made fiber staple, fiberglass and the like and an improved method and apparatus for forming the novel wire connections herein disclosed. The wire connection of the invention includes interconnectable double loops which are formed by a machine after the elongated straps are applied to the bales. The method and connection of the invention permits the highest compressed bales to be wrapped, such as a gin universal bale of cotton through an automated technique without requiring manual labor.

Under load, the strength of the wire connections of the invention will range upward to 100% of the break strength of the wire. The wire connection thus provides greatly improved strength characteristics over the typical square knot connections, commonly employed in attaching bale wire ends. The improved strength of the wire connection herein disclosed permits its positioning at the side of a highly compressed bale, such as a gin universal bale, where the highest stress points applied to the tie are normally encountered. This advantageous positioning is in contrast to the usual requirement of the square knot type connection to be situated at the top of such a highly compressed bale. Accordingly, the wire connections of the invention provides a non-manually formed means and method for attaching the ends of elongated wire members, such as used in baling applications, in a manner exceeding government specifications for cotton bale packaging material, as specified by the Commodity Credit Corporation. Improved apparatus for forming the wire connections of the invention automatically without manual labor is further disclosed herein and are capable of efficient operation, high reliability and the formation of superior connection demonstrating the improved qualities herein disclosed.

DESCRIPTION OF THE DRAWINGS

Further objects of the invention, together with additional features contributing thereto and advantages accruing therefrom, will be apparent from the following description of the preferred embodiments of the invention, which are shown in the accompanying drawings with like reference numerals indicating corresponding parts throughout, wherein.

DESCRIPTION OF THE PREFERRED EMBODIMENTS

Figures 1, 2, 3, 4, 5, 6:
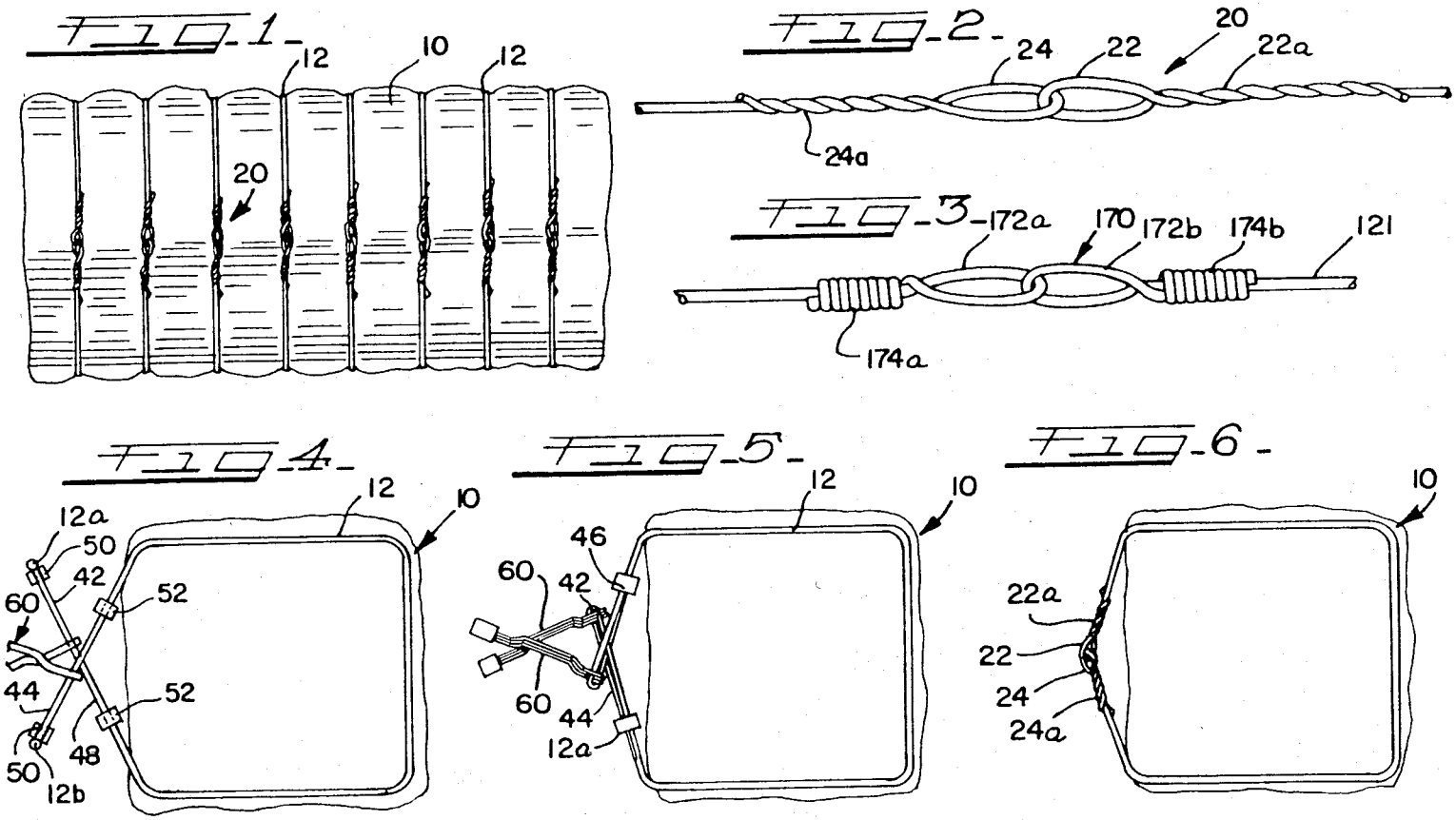
FIG. 1 is a front schematic view of a bale of material being secured by wire employing a first embodiment of the wire connection of the invention.
FIG. 2 is a partial side schematic view of one of the bale wires of FIG. 1 showing the first embodiment of the wire connection of the invention in a hooked or joined configuration.
FIG. 3 is a partial schematic side view of a second embodiment of the wire connection of the invention in a hooked or joined configuration.
FIG. 4 is an end schematic view illustrating a step for automatically applying wire to a bale in a wrapped-around relationshp and form the connection of FIG. 2 in accordance with embodiments of the invention.
FIG. 5 is an end schematic view illustrating the subsequent step to the step of FIG. 4 for automatically looping the end portions of the bale wire back to form the connection of FIG. 5.
FIG. 6 is an end schematic view illustrating the subsequent step of automatically twisting the end portions to form two closed interengaging loops in accordance with the embodiment of the wire connection of the invention as shown in FIG. 2.

Referring now to FIG. 1, there is illustrated a bale of material 10, such as cotton and the like, being secured or tied by a plurality of wires 12, each coupled by a first embodiment of the improved wire connection of the invention, generally designated by the reference numeral 20. Conventionally, a suitable plurality of wire ties are employed to secure a bale of cotton, such as eight ties required to wrap a universal bale having a density of at least 28 pounds per cubic foot. The baling wire 12 is in the form of steel wire that forms a continuous loop about the bale 10, after the ends of the wire are interconnected by the wire connection 20. Generally, the bale wire 12 is applied to the bale 10 while the bundle is in a fully compacted state by a typical press machine, such that upon removal from the machine, the wire 12 is subjected to a considerable loading transmitted by the compressed material of the bale 10. As shown in FIG. 1, the wire connection 20 of the invention may be effectively positioned along the sides of the bale 10, at which position the greatest load on the wire is usually present.

Referring now to FIG. 2, there is illustrated the first embodiment of the wire connector of the invention, generally designated by reference numeral 20, which retains the opposite ends of bale wire 12 in a bound configuration. The wire connection 20 is arranged as a double closed loop construction, having first and second loops 22 and 24, which are adapted to be formed by the improved method and apparatus of the invention by an automated technique as will be described. The first and second loops 22 and 24 are each formed by twisting the end portions thereof, until such time as the loops are formed. As is apparent, the plane of loop 22 may be disposed in an angular relationship to the plane of the opposing loop 24 and under tension or load, in many situations, is in a perpendicular orientation. Although connection 20 can be used with any type of bale, the double closed loop of the invention is particularly suitable for securement of highly compressed bales of cotton and the like, such as a gin universal bale as previously discussed. The strength of the double loop configuration of the invention is nearly 100% of the wire strength permitting the double loop connection of the invention to be situated adjacent the sides of the bale, even in securement of the most compressed bales having at least a density of 28 pounds per cubic foot. Universal bales generally require 9 gauge baling wire, on which the double loop connector 20 can easily be used with effectiveness. For optimum strength, end portions 22*a* and 24*a* shoulsd respectively form at least three twists or more with its adjacent portion of the wire for optimum support of loops 22*a* and 24*a*.

Referring now to FIGS. 4, 5 and 6, there is illustrated a unique method by which the wire connection 20 of the invention is applied automatically during compression of the bale directly at the site of wrapping. Although the method illustrated in FIGS. 4 to 6 is shown being performed by the improved apparatus for forming wire connections of the invention, it is within the scope of the method of the invention to form the novel wire connections herein disclosed by other suitable machines, if available. Thus, the technique of the invention is not intended to be performed by hand, since the 9 gauge wire for universal bales requires at least three tight twists which are not readily attainable by manual labor, even though loose twists can be made by hand, but are not effective in holding. In wrapping of a typical bale, such as a gin universal bale, the wire 12 continuously fed from a reel or coil of wire (not shown) by power feed rollers or wheels, such as rollers 30 shown in FIG. 7. The fed wire is directed around the bundle by conventional guides (not shown in FIGS. 4 to 6) with wire end 12*a* extending the wire to a point where the first end portion 42 of the wire 12 meets and overlaps another portion 44 of the wire. The wire is then cut at point 12*b* by suitable means associated with a wire gripper 50 of the invention to create an overlapping pair of end portions as shown in FIG. 4. A pair of looper assemblies 60 of the type to be described later or other means capable of functioning as required then loop or bend the end portions 42, 44 of the wire 12 back into engaged or double relationship as shown in FIG. 5. Twister blocks 52 of the type to be described in conjunction with the apparatus of the invention or other suitable devices then twist the doubled up end portions 42 and 44 of the wires to form three or more twists leaving the pair of loops 22 and 24 in an inter-engaged relationship as shown in FIG. 6.

Figure 8:
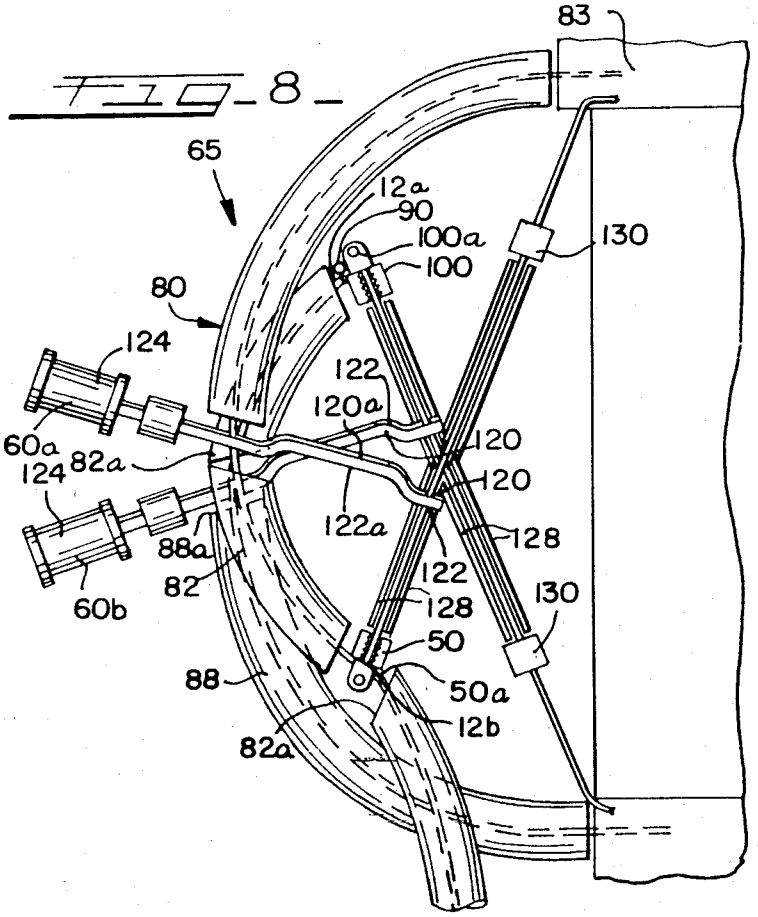
FIG. 8 is an enlarged partial side schematic view of the apparatus of FIG. 7.
Figure 7:
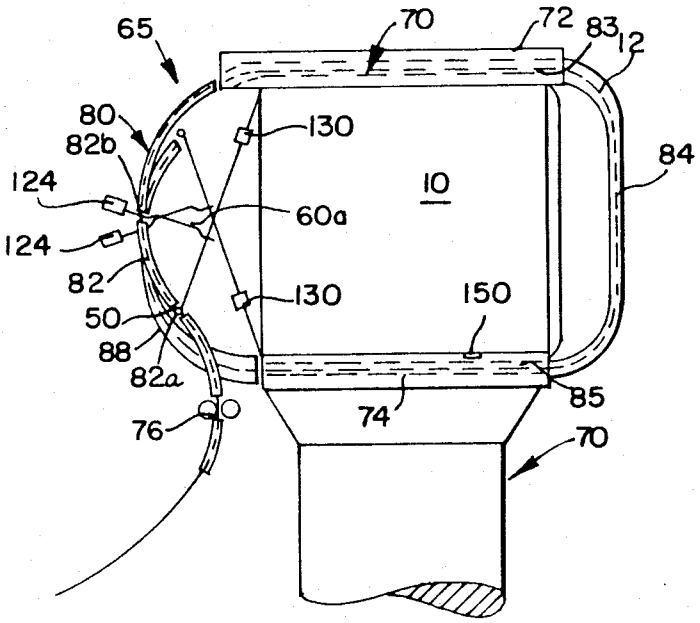
FIG. 7 is a side schematic view of a first embodiment of the apparatus for automatically forming wire connections for bale wire.

Referring now to FIGS. 7 to 12, there is illustrated an improved apparatus of the invention, generally designated by reference numeral 65, for automatically forming the wire connection 20 and carrying out the method of the invention illustrated in schematic form in FIGS. 4 through 6. Referring to FIGS. 7 and 8, the bale 10 of material, such as cotton and the like, is shown in a compacted form through the use of a conventional press ram assembly 70 having an upper jaw 72 and a lower jaw 74. Relative movement between the pressing surfaces effected by a hydraulic device and the like (not shown) compacts the bale as is known. The elongated wire 12 is generally applied to the compacted bale at a plurality of spaced positions to form the six to eight loops as previously described.

In FIG. 7, a side view of the apparatus 65 in applying a single loop of wire 12 is illustrated in schematic form. As stated in conjunction with the method herein described, the wire 12 is applied from a coil or reel of elongated material (not shown). The material is delivered for application to the bale through the use of a V-grooved power feed wheel assembly 76 which causes movement of the wire upward into a wire guide assembly 80. The wire guide assembly 80 includes a hollow entry guide 82 are formed by a pair of breaks or separations 82*a* and 82*b* respectively, to position the gripper and wire cut-off assembly 50 for access to the wire 12, and to permit looper 60*a* to extend through the guide as illustrated. The wire exiting from the guide 83 in the upper pressing surface 72 is directed into a rear wire guide 84 and is delivered to a built-in guide 85 of known design provided through the lower jaw 74. The wire from the lower guide 85 then passes through a return guide 88 having a separation 88*a* for looper 60*b*, and the wire makes contact with a limit switch feed control 90 associated with a pivotally mounted gripper 100 of any suitable design.

Figure 11:
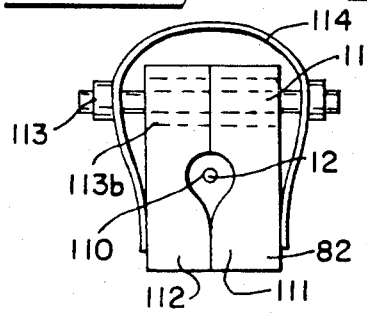
FIG. 11 is a sectional view taken along lines 11—11 of FIG. 8 showing the wire guide in a closed position.
Figure 12:
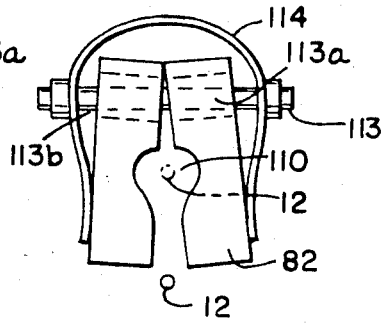
FIG. 12 is a sectional view taken along lines 11—11 of FIG. 8 showing the wire guide in an open position.

Each of the guides 82, 84 and 88 may be formed in the manner shown in FIGS. 11 and 12, illustrating the cross-sectional configuration of entry guide 82. The guide 82 includes a channel 110 defined by cut-out sections in jaws 111 and 112. A shaft assembly 113 extends through oversized holes 113*a* and 113*b* of jaws 111 and 112 to permit relative pivotal movement thereof. The jaws 111 and 112 are biased together by a resilient spring member 114 suitably coupled thereto in the manner shown in FIG. 11 to allow a wire 12 to pass therein. The wire 12 may be pulled through the jaws under tension, and the wire moved to an appropriate position to form a wire connection, when the end portion of the wire contacts the limit switch 90. As will be apparent, the pivoted gripper 100 clamps the wire 12 in a secured position to permit a reverse tension to be applied by wheel 30 and subsequently cause the wire to be oriented in the crossing pattern illustrated in FIG. 8. In FIGS. 7 and 8, the return guide 88 is positioned behind the entry guide 82. The power feed or wheel 76 does not form loops or twist the wire 12, but merely delivers the elongated material for application around the compacted bale 10. The guides 83 and 85 are mounted in means (not shown) also capable of releasing the wire 12 to contact the bale at the top and bottom thereof during application of tension to the wire. The components of the apparatus heretofore described are intended to be supported on a conventional housing and include standard power means and controls to function in the manner described.

Figure 9:
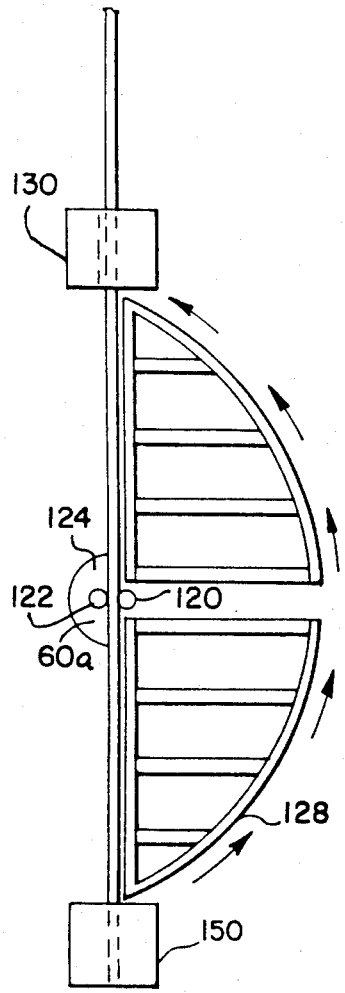
FIG. 9 is a partial side schematic view of the looper to twister guide of the apparatus of FIG. 8.
Figure 10:
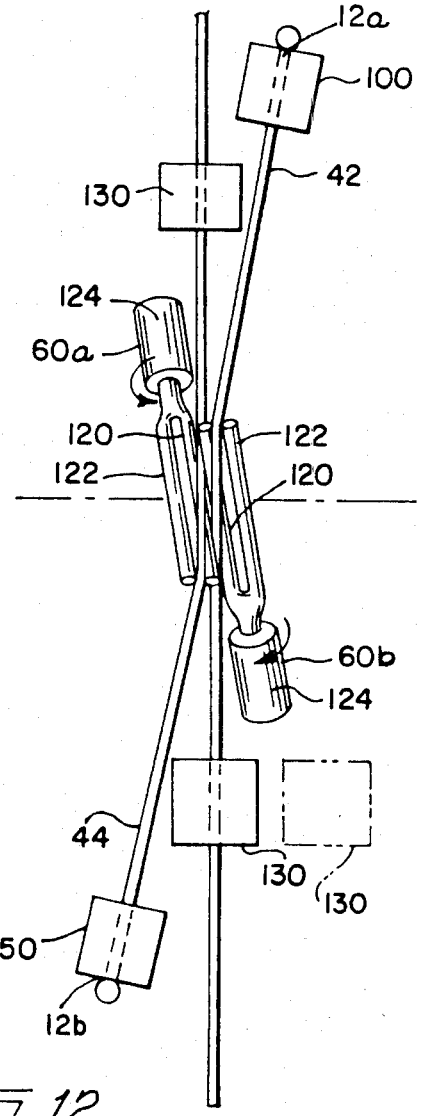
FIG. 10 is a partial back schematic view from the bale outward of the apparatus of FIG. 7.

As shown in FIGS. 8, 9 and 10, the apparatus 65 employs two looper assemblies 60*a* and 60*b* of the invention having a respective pair of elongated prongs 120 and 122, which embrace or grip a portion of the wire 12 to move the ends of the wire from the pivoted grippers 50, 100 to twister blocks 130. The prongs 120 and 122 of loopers 60*a* and 60*b* comprise a pair of rotatably mounted members supported by a suitable mechanism. In the position shown in FIGS. 7 and 8, the prongs 120 and 122 of loopers 60*a*, 60*b* rotate in the opposite direction to each other about respective axes to bring or fold the ends 12*a*, 12*b* of the wire, lying between the two pairs of prongs 120 and 122 and grippers 50 and 100, respectively, back into contact with twister blocks 130 in a manner outlined in FIGS. 4 and 5. The prongs 120 and 122 of each of the loopers 60*a*, 60*b* have matching off-set midsection portions 120*a* and 122*b* (FIG. 8) to insure that the prongs of looper 60*a* do not interfere with the prongs of the other looper 60*b* during rotation. The loopers 60*a*, 60*b* are respectively positioned within separations 82*a*, 88*a* in the entry guide 82 and the return guide 88 are in alignment with the guide opening to direct the spaced prongs 120, 122 during feeding movement of the wire 12 to form a loop around the bale. The wire 12 may then move relative to the prongs when a tensioning force in a manner to be described is applied to the wire to assume the configuration shown in FIG. 8.

The loopers 60*a*, 60*b* each include a motor 124 of suitable design coupled to the ends of the prongs 120 and 122 for effecting rotation of prongs 120, 122 about a central axis approximately parallel to their longitudinal axis. The prongs of loopers 60*a* and 60*b* are rotated in opposite directions (FIG. 10) for forming a connection 20 and then further rotated in either the same direction or back, if desired, to be returned in alignment with the wire guides before a tie is again applied to the bale. As illustrated in FIG. 10, the prongs of looper 60*a* are rotated counterclockwise, as viewed, after a wire 12 is guides therethrough, while the looper 60*b* is rotated clockwise. During the looping or folding back steps shown in FIGS. 7, 8, 9 and 10, the end portions of each of the wires which are held by the loopers 60*a* and 60*b* are guided by a guide assembly 128, as best shown in FIGS. 8 and 9, to direct the ends 12*a*, 12*b* of the wire to the respective upper and lower twister blocks 130 after release of the grippers 50, 100. The end portions of the wire are in effect swung by rotation of loopers 60*a*, 60*b* from grippers 50, 100 to twisters 130.

Each of the grippers 50, 100 are pivotally mounted by pivot assembly 50*a*, 100*a* (FIG. 8) to permit movement from a position during feeding adjacent the wire to a position shown in FIG. 8 after tensioning. The jaws of grippers 50, 100 are coupled to a suitable force applying means of a conventional design causing them to grip and release the wire, and to cause the grippers 50, 100 to pivot back to their wire receiving open position when wire is being fed. In a wire receiving position, the grippers 50, 100 are oriented by control means (not shown) to open and receive the wire during feed. While being gripped by the jaws 50*a*, 100*a*, reverse tensioning of the wire loop is effected by reversing the drive wheel 76 in accordance with a control signal generated by limit switch 90 supplied to the motor of the drive wheel after the wire is fed around the bale.

The twister blocks 130 may comprise any suitable design capable of grasping the looped back wire and then rotating the adjacent sections to twist the wire to form the connection of FIG. 2. Each of the twister blocks 130 includes separate power means (not shown) to cause twisting and to effect operative movement of the blocks. A rack and pinion of an appropriate construction may be employed to effect rotation or twisting action. The twister blocks 130 are adapted to move through the action of suitable means (not shown) from the position shown in phantom in FIG. 10 to a position embracing the wire, subsequent to the wire being tensioned after feeding by reversal of feed wheel 76. Upon the loopers 60*a* and 60*b* moving the end portions of the wire back through the guide assembly 128, the blocks 130 receive and secure a portion of the wire at its ends. The looped wire portions are retained at one end by the wire being wrapped around one of the prongs of each looper 60*a*, 60*b* as illustrated in FIG. 5 and being gripped at the other end by twister blocks 130. Thus, through rotation of the blocks 130, the twists of the wire connection of FIG. 2 are then formed in the manner of FIG. 6. Each of the twister blocks 130 may be independently powered to rotate for a duration and rate sufficient to create at least three twists as shown for the wire connection of FIG. 2.

In operation, each of the foregoing components, namely the power feed 76, loopers 60*a* and 60*b*, press 70 pivotally mounted grippers 50, 100 and twisters 130, may be independently powered by suitable means. An electrical control circuit of suitable design (not shown) is used to transmit a respective command signal to each power means to effect the proper sequence of operation as needed. Initially, the wire 12 is fed manually into the power wheel 76 to receive the wire. When the bale 10 has been compacted to a sufficient degree by press 70, a sensing device 150 (FIG. 7) associated with the lower pressing surface of the ran transmits an electrical signal to the control circuit to activate the power feed wheel 30. The signal to the power feed wheel 76 then energizes the feed wheel motor and continuously pulls the wire 12 from the source. The guide assemblies 82, 83, 84, 85, and 86, direct the wire around the bale, until such time as the end 12*a* of the wire contacts the limit switch 90 associated with the pivoted gripper 100.

Upon contact of the wire with the pivoted gripper 100, the gripper secures the wire, and the feed wheel 76 is deactivated. The motor driving feed wheel 76 is then reversed to tension the wire around the bale, while the wire is being held by gripper 100. The tensioned wire is then pulled from its releasable retention in the guide system 80 to cause the wire to overlap or cross as shown in FIG. 8. After the tensioning operation, the wire is retained by pivoted gripper 50 and is cut at point 12*a* by the cutter associated with gripper 50 to sever the loop from its source of supply. After being cut, a cutter sensor (not shown) transmits a signal to cause the grippers 50, 100 to loosen their grip on the wire ends. The prongs 120 and 122 of both loopers 60*a* and 60*b* are then caused to rotate and loop the end portions of the wire to a position where the wire ends 12*a*, 12*b* are respectively received in the twister blocks 130. Because of the angular, overlapping relationship of the wire end portions and the direction of rotation of the prongs of the loops, the wire loops being formed interconnect as shown in FIG. 5.

With ends 12*a*, 12*b* being held by twister block 130, the wire connection of FIG. 2 is then completed by the twisting action of blocks 130. After completion of the wire connection 20, a detector (not shown) associated with the twister blocks 130 transmits a signal back to the control circuit (not shown). The press ram 70 is then caused to be lowered allowing the compacted fiber to rebound into the wire ties 12 in a proper compression. As the compacted bale rebounds in a vertical direction, the wire is pulled from the twister block 130 tightly around the compacted bale retaining the material in its compacted state. The finished bale is ejected from the press and is ready for the next bale to be compacted.

As described in the foregoing sequence of operation of the apparatus of FIGS. 7 to 12, a single bale wire loop as described is applied to the bale 10. As is clear from FIG. 1, six to eight bale wires are conventionally applied, and the machine of the invention can apply such multiple ties to the wire through various techniques. Obviously, a single head applying a single wire at a time may be indexed by conventional means for movement relative to the bale until such time as six to eight wires are applied. Alternatively, a pair of heads 65 as shown in FIGS. 7 and 8 applying a single loop may be applied on opposite sides, whereby wire connections 20 would be disposed on both sides of the bale. For fully automatic and high speed applications, a plurality of heads 65 may be stationed along the side, such as eight in number, whereby eight ties are simultaneously applied.

The unique design of the machine of the invention is capable of feeding, tensioning, and looping and twisting to perform the method of the invention. Generally, when the wire is reeled from a coil or reel of wire and is guided around the bale at six or eight stations, a reverse tension is applied to the wire, while the threaded end is being retained, to pull the wire from the guide system and remove slack from the wire prior to cutting. After the reverse tension is applied to the wire, the wire can be cut and the steps of the automatic overlapping, looping and twisting as shown in FIGS. 3, 4 and 5 can be accomplished.

Referring now to FIGS. 14–17, there is illustrated a second embodiment of the apparatus for automatically forming the wire connection 20 and carrying out the method of the invention, such as illustrated in schematic form in FIGS. 4–6. The second embodiment of the apparatus shown in connection with FIGS. 13–17 is generally designated by the reference numeral 265 and functions, in a similar manner, with certain modifications, as described in connection with the apparatus of FIGS. 7–12. Similarly as in the previously described embodiment, the various components of the apparatus 265 perform a number of operations requiring a control circuit of any suitable type and employing electrical or pneumatic components to operate in a desired sequence a plurality of motors and power devices, some of which are shown in schematic form in FIGS. 13–17. The various drive mechanisms associated with the apparatus of FIGS. 13–17 provide for the insertion and looping of the wire 12 around the bale and for subsequent operations to create the connection 20.

Figure 13:
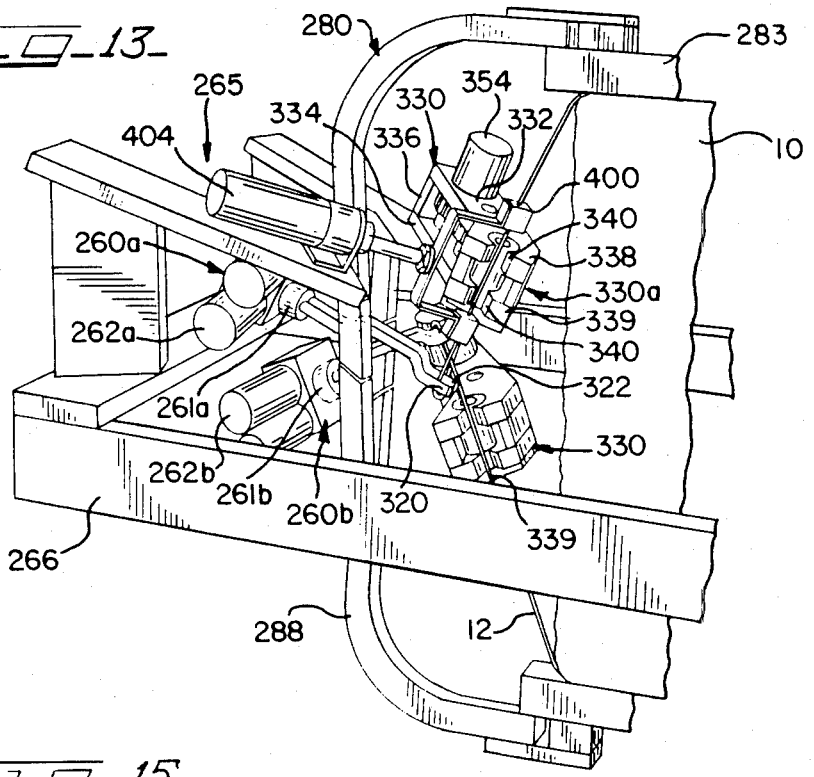
FIG. 13 is a perspective view of a second embodiment of the apparatus of the invention for automatically forming wire connections.
Figure 14:
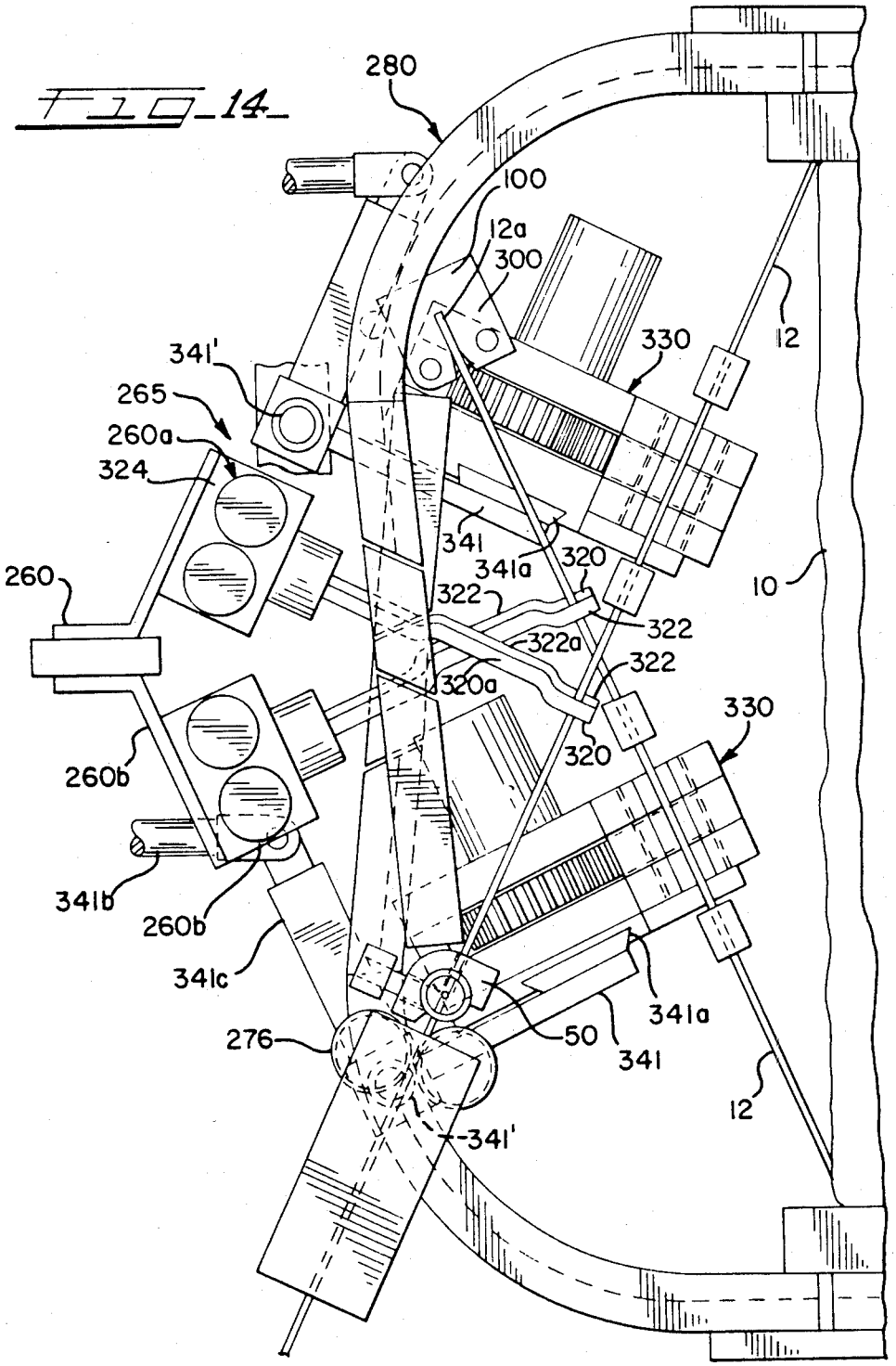
FIG. 14 is an enlarged side schematic view of the apparatus of FIG. 13.

Referring to FIGS. 13 and 14, the apparatus 265 includes a mounting frame 266 which may be of any appropriate design to support the various components of the machine adjacent to the bale to be wrapped and a connection applied. The apparatus 265 further is provided with wire guides 280, including an entry guide 282, a guide 283 within the upper and lower press jaws, and a lower return chute or guide 288. Wire 12 is fed to the apparatus 265 through a pair of drive rollers 276, powered by a motor drive (not shown). The rollers are driven to direct the wire around the bale 12 through the guide system 280 as in the previously described embodiments.

The apparatus 265 is further provided with looper assemblies 260*a* and 260*b*, of a similar design as previously described. Looper assemblies 260*a*, 260*b* are mounted on brackets 260*a*′ and 260*b*′ carried on frame 266. Each of the looper assemblies 260*a*, 260*b* includes spaced, elongated prongs 320, 322 that embrace a portion of the wire directed around the bale as was described with reference to the previous embodiment. The prongs are rotated about a central axis to swing or bend back the end portions of the wire after being respectively released from the pivotally mounted gripper assembly 100 and the lower pivoted gripper/cutter 50. The prongs 320, 322 of each of the loopers 260*a*, 260*b* are rotated by motor 262*a*, 262*b* to cause the swinging action of the end portions of the wire. After the end portions are bent or doubled back, the loops are anchored or retained by the stationary prongs 320, 322 after rotation, and the twister assemblies 330 are mounted to move into contact with the double wire arrangement of the bent back wire portions.

Referring now to FIGS. 13 to 19, the improved twister assemblies 330 of the present embodiment of the invention are best illustrated. The twister assemblies 330 are mounted on the frame 266 of the apparatus and each include a wire receiving head 330*a*. Each twister head 330*a* is adapted to move from a position remote from the wire to a position for engaging or straddling a portion of the bent back portions and apply the requisite number of twists to the wire for forming the wire connection of the invention. The twister assemblies 330 include a housing structure 331 in the form of a slidable block assembly having sidewalls 332, 334 and an end wall 336. The twister head structure 330*a* is located at the opposite end of the sidewalls 332, 334 from wall 336 and id directed angularly toward the wire in its lower position. The heads 330*a* include a pair of walls 338, 339, each having an open slot 340 formed with tapered wire receiving mouth.

The housing 331 is slidable on a slide bar base 341 within a tapered slot 341*a* (FIGS. 14, 18 and 19) to be moved toward and away from the wire portions by pneumatic cylinders (not shown) respectively connected to the housing 331. The slide bar 341*a* is, in turn, pivotally mounted on the frame by pivot assembly 341′ to raise the twister assembly to a position remote from the bale or to lower it to a wire contacting position through the action of the extendable end 341*b* of a second pneumatic actuator which is affixed to an arm 341*c* integral with the slide bar base 341. A pinion drive gear 342 is mounted for rotation on shaft 343 journaled on the sidewalls 334, 336. The drive gear 342 meshes with an intermediate pinion gear 345, also journaled on the sidewalls by virtue of a shaft 346. The walls 338, 339 of twister head 330*a* further support a twister pinion gear 348 mounted on its own two hubs 349.

Figure 15:
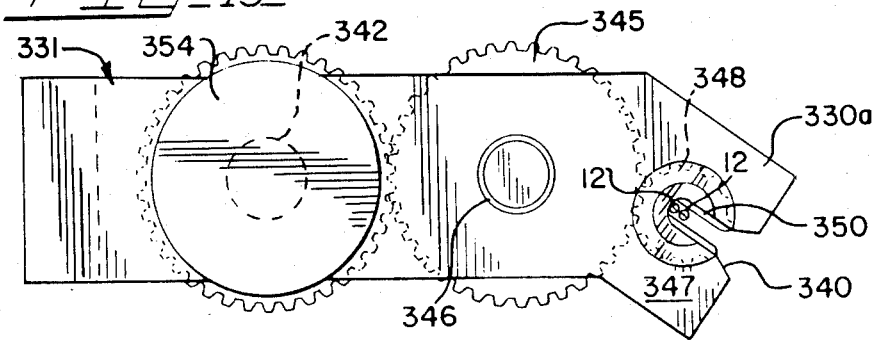
FIG. 15 is a top view of the drive assembly of FIG. 14.
Figure 16:
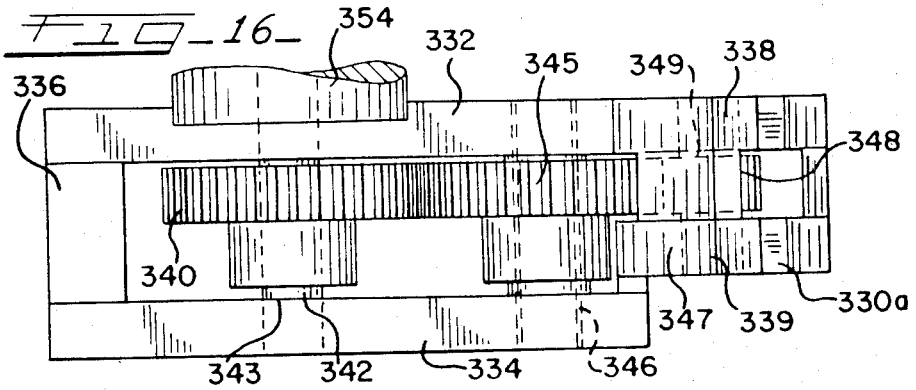
FIG. 16 is an enlarged partial side view of the spacer twister block drive assembly of the apparatus of FIG. 14.

As best shown in FIG. 15, the pinion gear 348 includes an elongated open ended slot 350 that extends from its periphery to a point radially inward generally terminating at the center line of the axis of rotation of the pinion. Upon proper indexing of the pinion 347, the slot 350 is adapted to be radially aligned with the slot 340 formed by a cut-off portion in walls 347, such that the folded back wire portions 12, may be situated within the pinion 348 as shown in FIG. 15. Upon the two wire segments being positioned as shown in FIG. 15, rotation of the pinion 348 will cause the wires to undergo three or more twists to secure the connection as illustrated in connection with FIG. 1. Motion is imparted to the pinion gear 348, which is in meshing relationship with pinion 345, by a conventional pneumatic or electric motor 354 mounted on wall 332 and adapted to rotate the drive gear 340.

Figure 19:
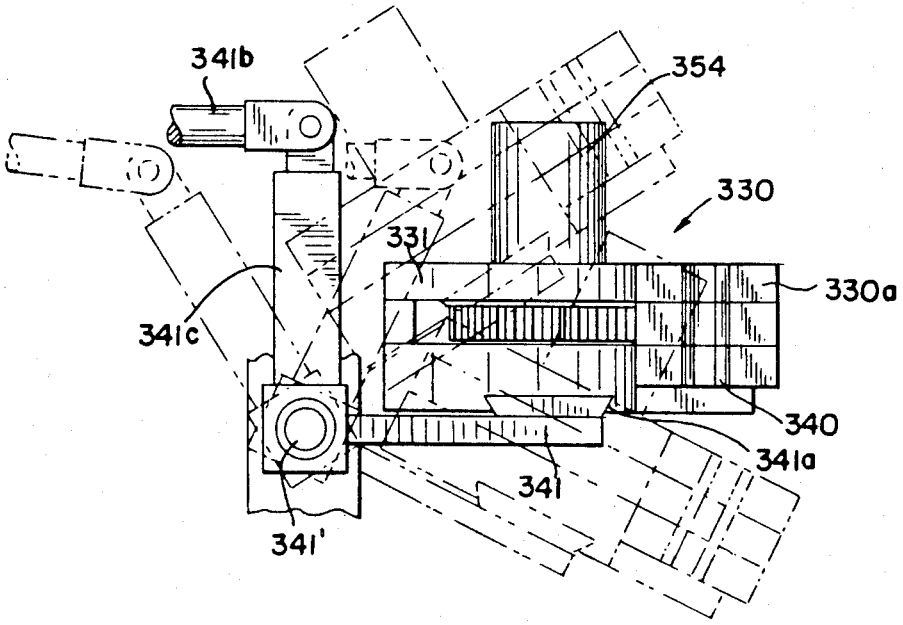

The twister assemblies 330 are pivotally mounted upon the support structure of the apparatus along a generally horizontal axis in a manner to be lowered and raised relative to the bale as shown in phantom in FIG. 19. Upon being lowered adjacent a fed wire in proper sequence, the twister housing assembly moves as in FIG. 18 into contact with the wire within pinion slot 350 after the wire portions 12 are doubled back by the looper. After being in proper position, the motors 354 of each twister assembly 330 rotate the pinions 348 for a number of revolutions sufficient to create three or more twists on each side of the connection.

Figure 17:
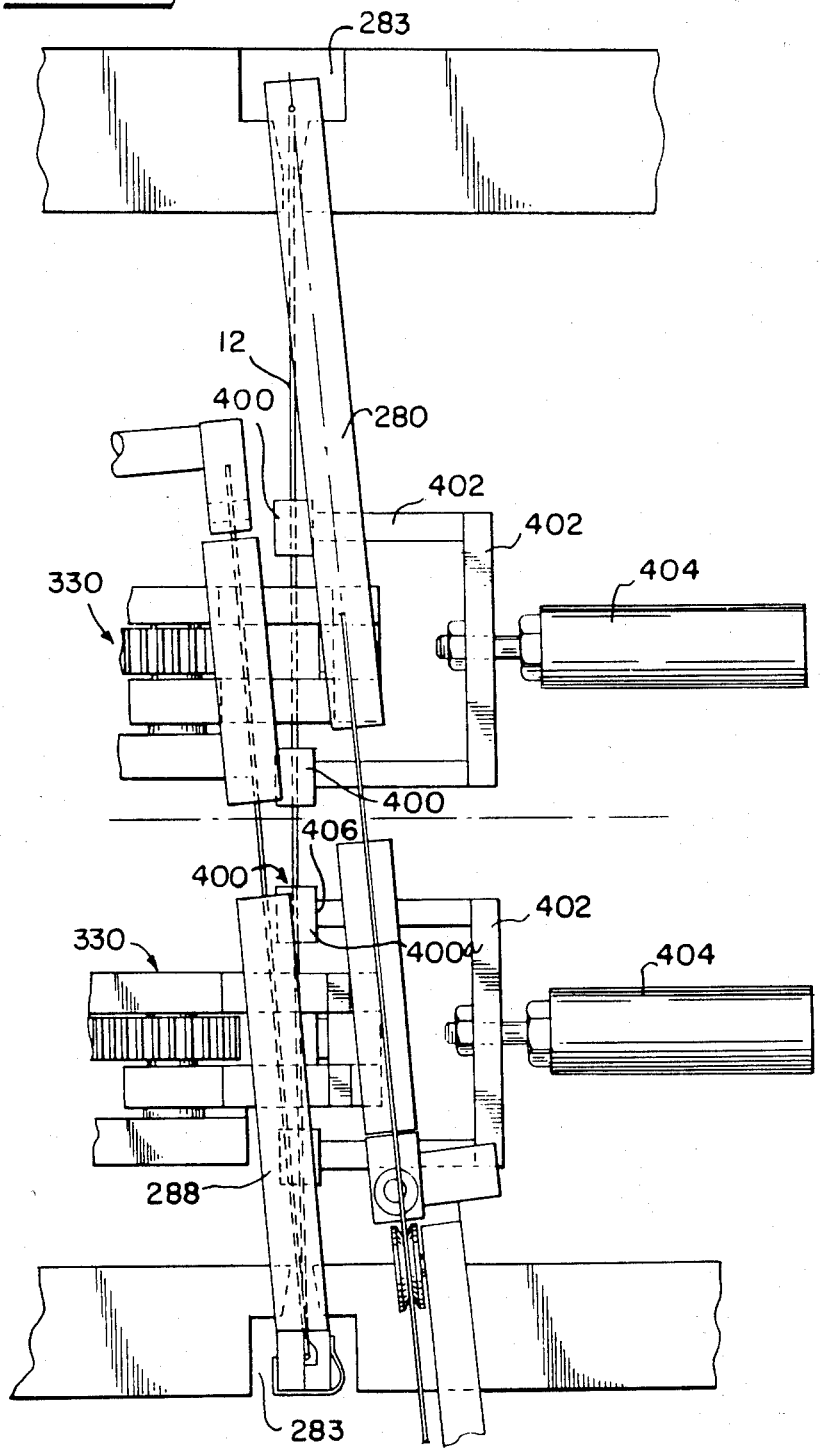
FIG. 17 is a rear schematic view of the embodiment of FIG. 13.
Figure 18:
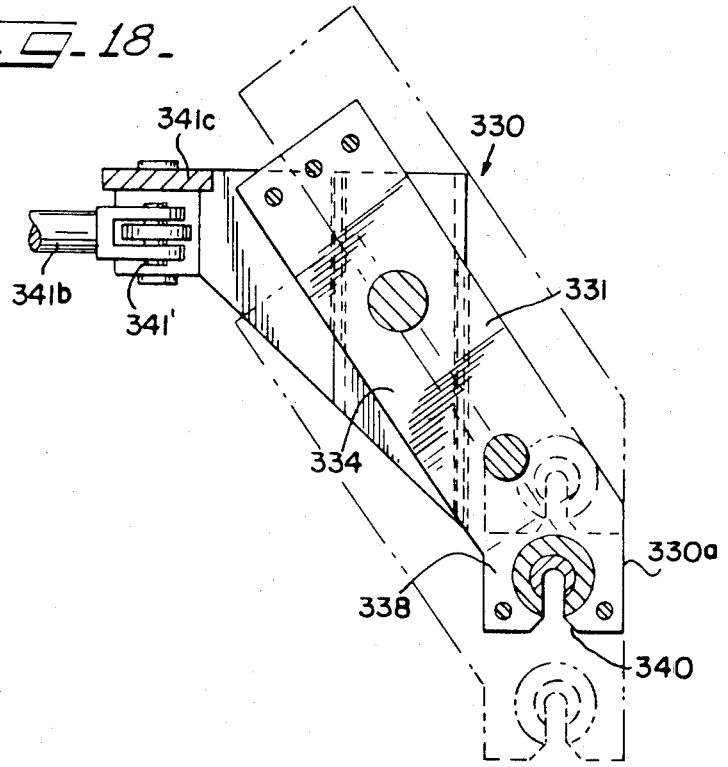
FIG. 18 is an end schematic view of one of the twister assemblies of the apparatus of FIG. 13; and, FIG. 19 is a top schematic view of the twister assembly of FIG. 18.

The second embodiment of FIGS. 13–17 includes moveable wire guides and braces that contact the wire prior to the twisting assemblies 330 being moved into operative position. The guides 400 are supported on a pair of U-shaped support assemblies 402 which are best shown in FIG. 17. The support assemblies 402 are mounted on the extendible ends of separate pneumatic cylinders 404 carried by the frame. The support assemblies 402 are provided with a pair of ends 406 on which a respective guide 400 is attached. The guides 400 are formed as generally V-shaped surfaces 400*a* capable of contacting and supporting the wire as shown in FIG. 17. The guides 400 are arranged along an approximate vertical orientation in back of the wire to brace the wires as the twister assemblies 330 move to straddle the wire in the opposite direction for a twisting operation.

In operation, the apparatus 265 has a similar sequence of operation as the preceding embodiment of FIGS. 7–12 and is controlled by a conventional control circuit not forming part of the present invention. The control circuit may be responsive to position detectors, time delay circuits and the like which may direct operation of the motors and force applying devices operating the power drive rollers 276, gripper/cutter assembly 100, gripper assembly 50, looping assemblies 260*a* and 260*b*, and twisted assemblies 330. Initially, the motor driving the drive wheels 276 is energized to cause the wire to feed around through the guide system 280 to a point where the lead end of the wire 12 engages the gripper 100, at which point a force applying device, such as, for example, a fluid actuator of a pneumatic or hydraulic type (not shown) associated therewith, is energized to grip the end of the wire. Thereafter, a control signal is directed to the electric or pneumatic motor (not shown) driving the feed wheels 276 to reverse the motion and apply tension to the wire while the end is held by gripper assembly 100.

A force applying device in the form of a pneumatic actuator and the like, associated with the cutter and gripper 50, is energized to cut the wire and create a trailing end. Subsequently, the pneumatic actuator of gripper assemblies 100 is de-energized to release the two ends of the wire. After release of the wire ends, the pneumatic cylinders 404 move the guides 400 into contact with the wire. Subsequently, the motors 261*b* are energized to rotate the prongs 320, 322 of the loopers to bend back the relatively stiff end portions of the wire as in the previously embodiment. However, in the previous embodiment, the wire end portion are bent back into stationary twister assemblies. In the second embodiment of FIGS. 13–17, the twister assemblies are moved from a remote position to a wire contacting position. To accomplish this movement, a fluid actuator (not shown) coupled to the twister block pivot assembly of each twister assembly 330 causes twister assemblies 330 to be lowered to a point in alignment with the bent back wire portions. A second pneumatic or similar actuator (not shown) operatively coupled to the slidable block assembly 331 moves the head 330*a* to the wire contacting position where the two wire portions are straddled as shown in FIG. 15.

The motor 352 is then energized to drive the pinion 348 and cause it to make suitable number of turns, such as $3\frac{1}{2}$, and twist the wires together. After the motor 352 is de-energized to stop rotation of the pinion 348, the motor, if desired, reverses the pinion 348 a partial rotation, such as a half turn. Thereafter, the twister motor 352 is de-energized. The pneumatic cylinders of thw twister block are then reversed and energized in a manner to induce its movement away from the wire, and the twister assemblies 330 are raised through actuation of the pivot actuator cylinder. The cylinders 404 controlling the support guide assemblies 400 are also withdrawn from contact with the wire to a start position to allow another operation. In the above-described technique of operation of the apparatus 265, a wire connection of the type shown in FIG. 2 is created.

Referring now to FIG. 3, there is illustrated another embodiment of the double loop wire connection of the invention, generally designated by reference numeral 170. The wire connection 170 includes a pair of interconnecting continuous loops 172*a* and 172*b*. The loops 172*a* and 172*b* of the wire 12' around a portion wire adjacent the loops 172*a* and 172*b*. Such wrapping of the end section of the wire around the main body is intended to be performed automatically during baling, and not manually, through a similar method as shown in FIGS. 4, 5 and 6. It should be apparent that modified twister blocks 130 of the apparatus of FIGS. 7–12 would be used to perform the connection 170 requiring wrapping rather than twisting as in the previous embodiment.

While the invention has been described with reference to several embodiments, it will be understood by those skilled in the art that various changes may be made and equivalents may be substituted for elements thereof without departing from the scope of the invention. In addition, many modifications may be made to adapted a particular situation or material to the teachings of the invention without departing from the essential scope thereof. Therefore, it is intended that the invention not be limited to the particular embodiments disclosed as the best mode contemplated for carrying out this invention, but that the invention will include all embodiments falling within the scope of the appended claims.

What is claimed is:

1. A method of automatically applying and connecting a continuous loop of bale wire to a bale of material without manual labor comprising the steps of:

feeding wire around from a continuous coil through a guide situated adjacent the periphery of a bale of material;

overlapping an end portion of said fed wire with another portion thereof after being looped around the bale;

cutting the wire at said another portion to create a second wire end portion;

looping both end portions of said wire back to form interengaging loops coupling said wire end portions together; and twisting two portions of said wire together adjacent each of said loops to form and support said interengaging loops.

2. The method according to claim 1 wherein said two end portions adjacent each loop are twisted in at least three twists.

3. The method according to claim 1 further comprising the step of applying reverse tension to said fed wire prior to said overlapping of said end portion with said another portion.

* * * * *